US007866469B2

(12) United States Patent
Fulton

(10) Patent No.: US 7,866,469 B2
(45) Date of Patent: Jan. 11, 2011

(54) STORAGE DEVICE

(76) Inventor: Kevin J. Fulton, 3421 Morningdove, Lawrence, KS (US) 66049

( * ) Notice: Subject to any disclaimer, the term of this patent is extended or adjusted under 35 U.S.C. 154(b) by 621 days.

(21) Appl. No.: 11/524,727

(22) Filed: Sep. 21, 2006

(65) Prior Publication Data

US 2008/0073236 A1 Mar. 27, 2008

(51) Int. Cl.
*B56D 73/00* (2006.01)

(52) U.S. Cl. ..... 206/372; 206/373; 206/457; 206/1.5

(58) Field of Classification Search ..... 206/457, 206/372, 373, 1.5, 6.1, 566; 220/23.83, 23.86, 220/23.88, 23.87, 23.89, 507, 4.21, 476; 248/552; 224/401; 292/194, 212, 229, DIG. 11; 53/471, 170, 173, 449
See application file for complete search history.

(56) References Cited

U.S. PATENT DOCUMENTS

| | | | | | |
|---|---|---|---|---|---|
| 342,502 | A | * | 5/1886 | Dennis | 292/209 |
| 1,373,156 | A | * | 3/1921 | Tebbetts | 206/546 |
| 3,188,034 | A | | 6/1965 | Jackson | |
| 4,667,491 | A | | 5/1987 | Lokken et al. | |
| 4,705,308 | A | * | 11/1987 | Bisbing | 292/108 |
| 4,993,762 | A | | 2/1991 | Rogers et al. | |
| 5,271,649 | A | * | 12/1993 | Gromotka | 292/113 |
| 5,301,829 | A | * | 4/1994 | Chrisco | 220/521 |
| 5,462,318 | A | * | 10/1995 | Cooke | 292/200 |
| 5,575,401 | A | * | 11/1996 | Trower et al. | 220/522 |
| 6,203,087 | B1 | | 3/2001 | Lance et al. | |
| 6,550,824 | B1 | * | 4/2003 | Ramsauer | 292/126 |
| 2005/0061841 | A1 | | 3/2005 | Farentinos | |
| 2005/0274763 | A1 | | 12/2005 | Hansen | |

* cited by examiner

*Primary Examiner*—Ehud Gartenberg
*Assistant Examiner*—King M Chu
(74) *Attorney, Agent, or Firm*—Intellectual Property Center, LLC; Arthur K. Shaffer

(57) ABSTRACT

A storage device including a cap, an outer container, an inner container, a storage structure and a theft prevention mechanism associated with the outer and inner containers. The outer container includes an outer sidewall and a top, the inner container includes an inner sidewall and a bottom. The storage structure includes an upper structure, a lower structure and an inner sidewall structure corresponding to said top, bottom and inner sidewall respectively which is generally adapted to receive valuables. Additionally, the present invention includes a method for storing valuables including providing an inner and outer container configured to simulate a vehicle accessory, positioning the theft prevention mechanism between said inner and outer containers, biasing said theft prevention mechanism in an unlatched condition, opening said containers, storing valuables within said inner container, closing said containers and latching said inner and outer containers by operating said theft prevention mechanism.

11 Claims, 3 Drawing Sheets

STORAGE DEVICE

FIELD OF THE INVENTION

The present invention relates generally to the storing of valuables and more specifically relates to the storage of valuables in a container that resembles a vehicle accessory such as a fuel storage canister mounted on a vehicle.

BACKGROUND OF THE INVENTION

Safely storing valuables in a manner which avoids easy detection yet provides convenient access is a known problem. One common solution is to secure the valuables in a storage container which is left in a building or structure, using a key lock or combination lock on the door of the safe which limits access to the stored valuables. However these containers are often easily identifiable by the key lock or combination lock usually contained on the outer container door. Once identified, a thief may direct his attention to this container to remove the valuables. In addition, some storage containers are made for installation within a building structure and are therefore heavy and bulky. These storage containers are not easily transported from one location to another. Some items which are valuable or contain valuable information, like a personal digital device or cellular phone, are designed to be transported from one location to another and may be easily stolen if left unguarded. It would therefore be beneficial to have a transportable storage container which securely stores valuables while not being readily identifiable as a storing container for valuables.

SUMMARY OF THE INVENTION

The present invention provides a storage device for storing valuables including a cap, an outer container with an outer sidewall and a top, an inner container having an inner sidewall and a bottom with a storage structure having a upper structure, a lower structure and an inner sidewall structure generally located between the inner container received by the outer container and a theft prevention mechanism associated with the inner and outer containers for securing the storage structure. The upper structure lower structure and inner sidewall structure generally correspond to the top, bottom and inner sidewall respectively. Alternatively, the present invention provides a method for storing a valuable item including the steps of providing an inner and an outer container configured to simulate a vehicle accessory, positioning a theft prevention mechanism between said inner and outer containers, biasing said theft prevention mechanism in an unlatched condition, opening said inner and outer container, storing valuables within said inner container, closing said inner and outer containers and latching said containers by operating said theft prevention mechanism to a latched condition.

BRIEF DESCRIPTION OF THE DRAWINGS

The drawings constitute a part of this invention and include exemplary embodiments of the present invention and illustrate various objects and features thereof.

DETAILED DESCRIPTION

I. Introduction.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

II. Storage Device.

Figure 1:
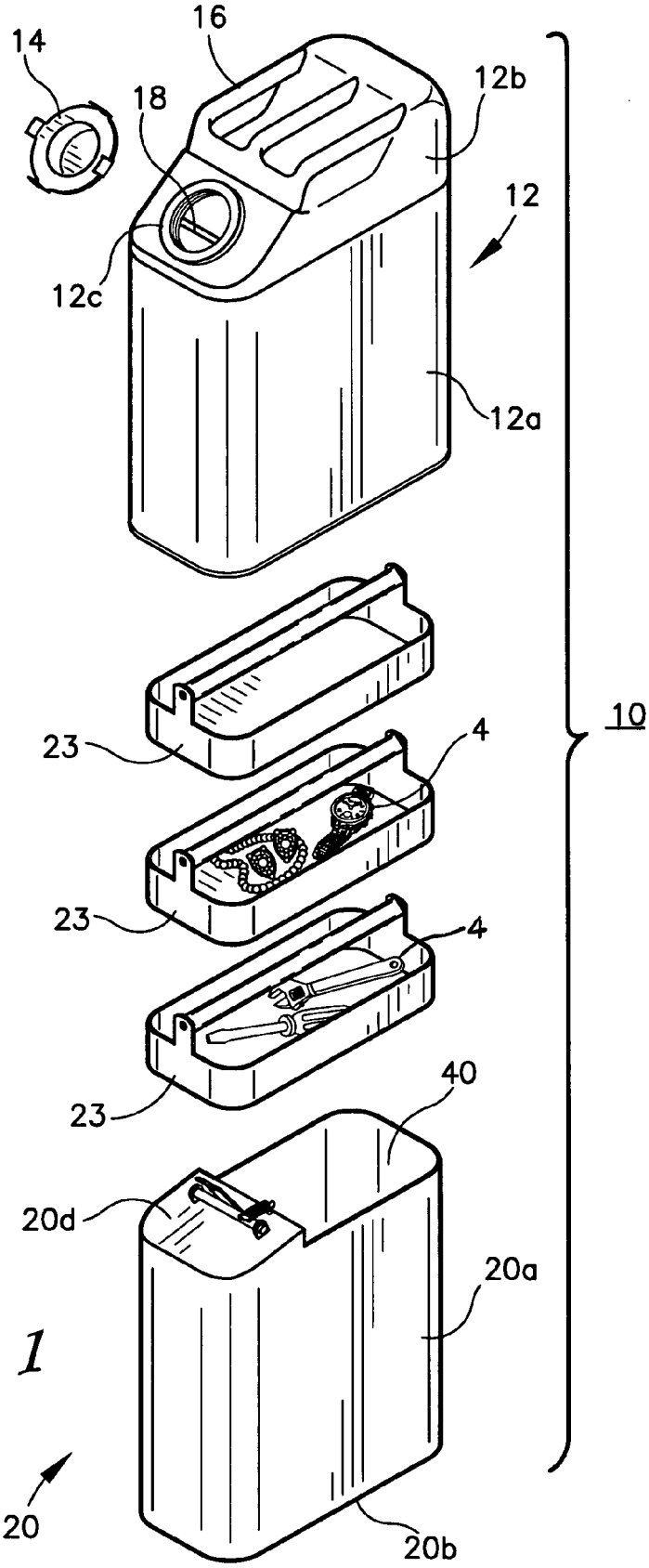
FIG. 1 is an exploded perspective view of the storage can in accordance with one embodiment of the present invention.
Figure 2:
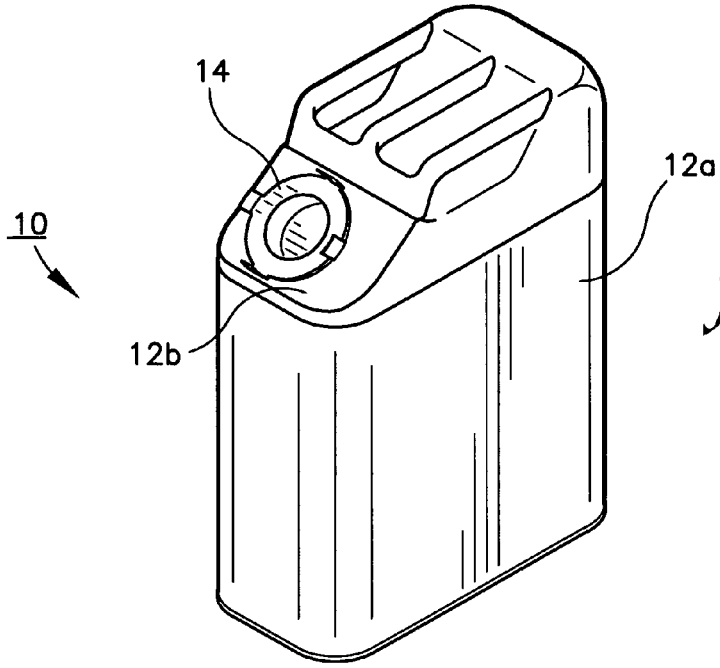
FIG. 2 is a front perspective view of the storage can according to the embodiment of FIG. 1.
Figure 5:
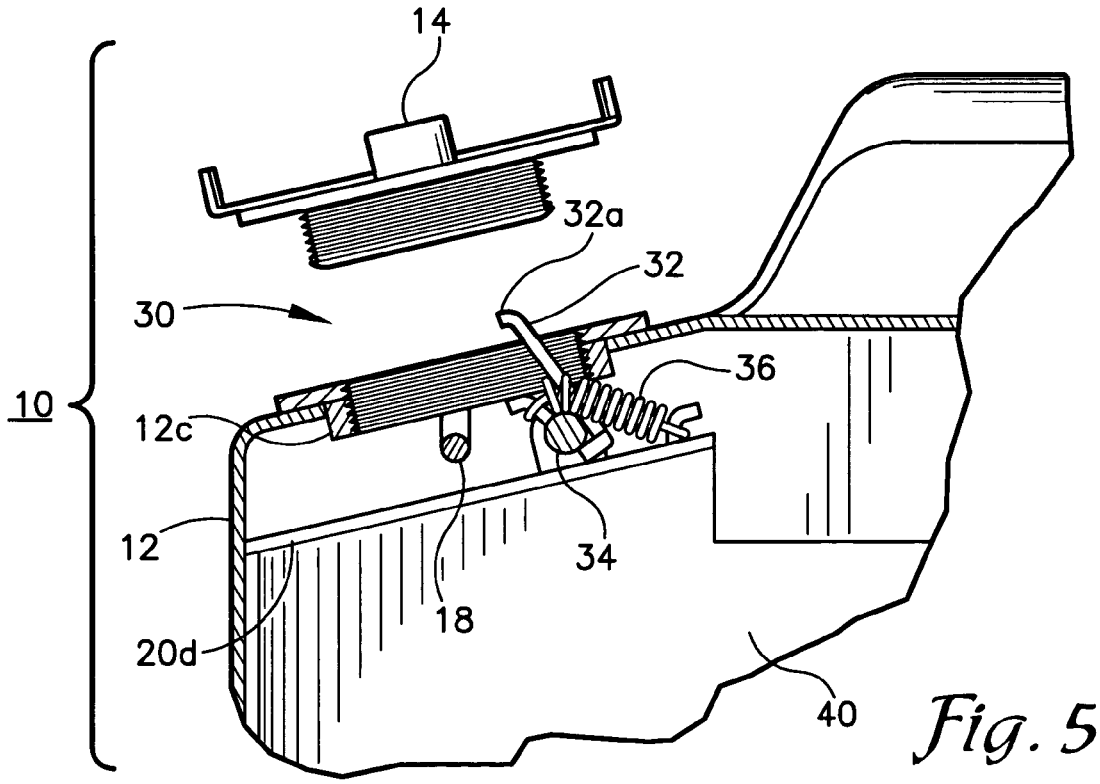
FIG. 5 is a partial cross-sectional view of the storage can in an open, unlatched position, in accordance with the embodiment of FIG. 1.

Referring to FIG. 1, an embodiment of the present invention a storage device generally indicated by reference numeral 10 for mounting on a vehicle 2 for transporting and storing the device 10. In FIG. 1 the storage device 10 is illustrated with an outer container 12 having an outer sidewall 12*a* and a top 12*b* separated from an inner container 20 having an inner sidewall 20*a* and a bottom 20*b*. FIG. 1 illustrates the device 10 in an open position the inner container 20 being generally spaced from the outer container 12*a* for receiving or retrieving valuables 4. FIG. 2 illustrates the device 10 in a closed position, the inner container 20 being telescopically received by the outer container 12. The inner and outer containers 20, 12 are configured to disguise the storage device 10 or to otherwise simulate a common vehicle accessory such as, but not limited to, a fuel storage canister. Alternative configurations of the device 10 may include configuring the inner and outer containers 20, 12 to resemble a tire accessory, a door accessory, a roof accessory or lighting accessory, a body accessory or an undercarriage accessory. As shown in FIG. 5, the device 10 may also include an optional theft prevention mechanism 30 for deterring the unsolicited removal of any stored valuables 4.

FIG. 1 also illustrates optional horizontal accessory trays 23 adapted for receipt within a storage structure 40 for organizing any received valuables 4. In addition to the optional horizontal accessory trays 23, the storage structure 40 may include additional organizing structures having horizontal or vertical shelves, racks, bins, hangers or drawers for storing and organizing stored valuables 4.

Figure 3:
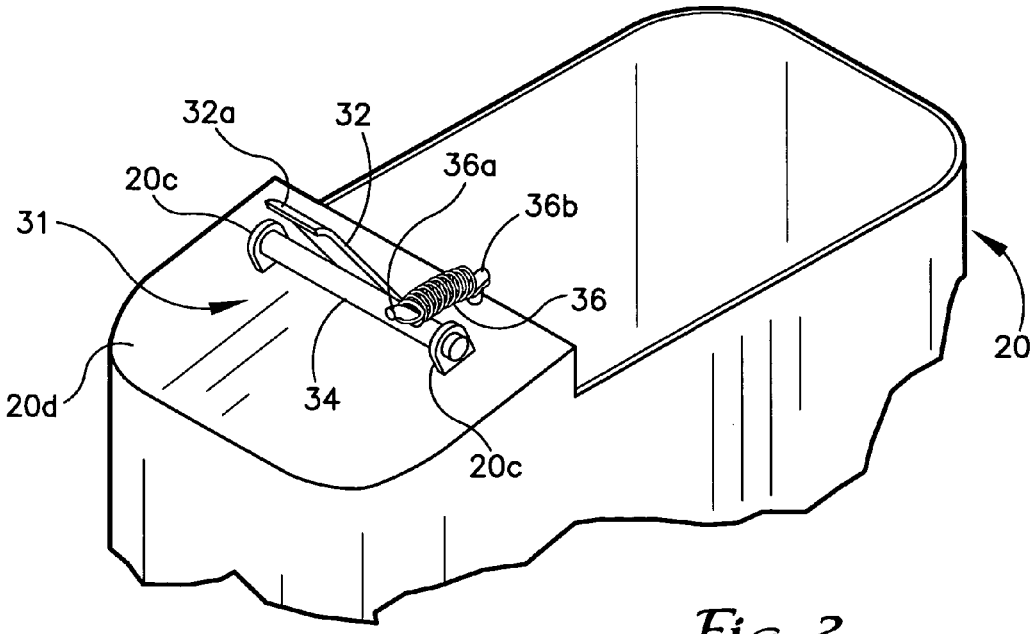
FIG. 3 is a close-up perspective view of a latch mechanism of the embodiment of FIG. 1.

Generally, the theft prevention mechanism 30 is associated with both the inner and outer containers 20, 12 and is adapted for movement between an unlatched condition and a latched condition. In the latched condition, the theft prevention mechanism 30 may secure the inner and outer container 20, 12 while the device 10 is in the closed position. FIG. 3 illustrates an embodiment of the theft prevention mechanism 30 including a latch 31 associated with the inner container 20, upper support 20*d*. The latch 31 is generally adapted for receipt by a catch 18 associated with the outer container 12. In the latched condition of FIG. 4, the catch 18 securely receives the latch 31 and generally releases the latch 31 while the theft prevention mechanism 30 is in the unlatched condition of FIG. 5. Alternative configurations of the theft prevention mechanism 30 may include a key lock, a push button mechanism, a threadable fastener or some other form of complementary interlocking fastener. As illustrated in FIG. 3 the latch 31 generally includes an elongated arm 32 extending from a latch bar 34 mounted by a support bracket 20*c* on the upper support 20*d*, the elongated arm 32 including a depending lip 32*a* associated with a distal end thereof.

A bias member 36 is also illustrated as part of the theft prevention mechanism 30, the member 36 operably connected between the latch bar 34 and the inner container 20 for biasing the theft prevention mechanism 30 towards the unlatched condition. As the distal end of the elongated arm 32 is pressed downward, the latch bar 34 is rotated, extending the member 36. In this manner, the theft prevention mechanism 30 may move from an unlatched condition to a latched condition, the bias member 36 extending therebetween. A first bias member receiver 36*a* is located on the latch bar 34 and a second bias member receiver 36*b* is located on the inner container 20, securing the bias member 36 between the inner container 20 and the latch bar 34, biasing the latch 31 towards the unlatched condition.

In the open position, the inner container 20 may be separated from the outer container 12 for the receipt of valuables 4. Optionally, the accessory or organizing trays 23 may be received by the inner container 20 for organizing any stored valuables 4.

Figure 4:
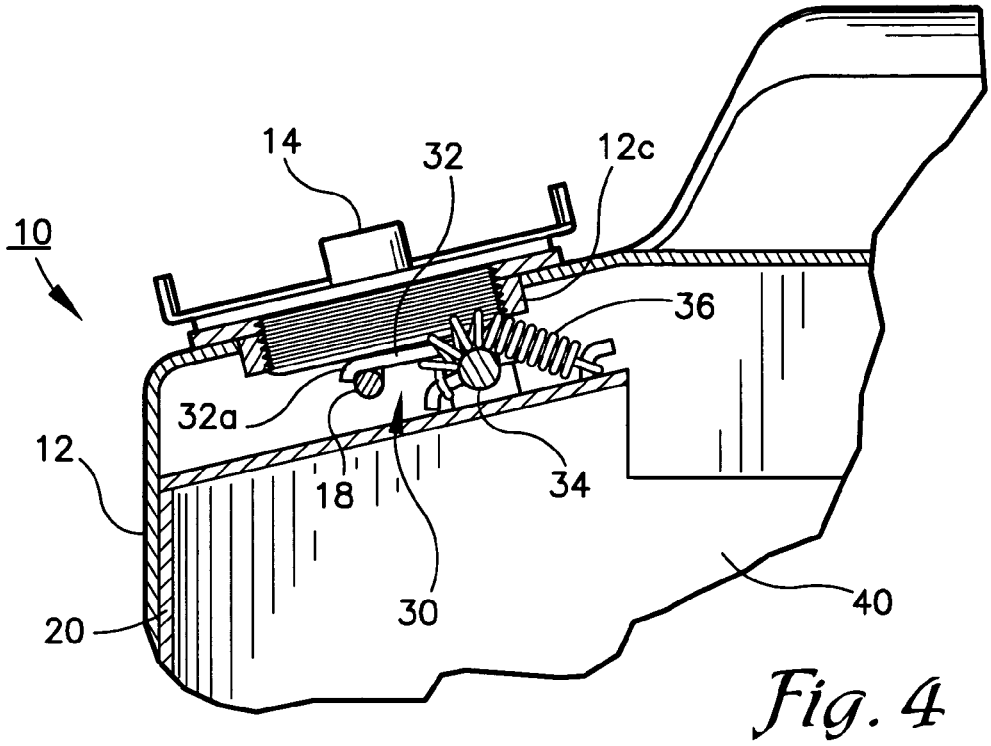
FIG. 4 is a partial cross-sectional view of the storage can in a closed, latched position, in accordance with the embodiment of FIG. 1.

The outer container 12 is illustrated in FIG. 4 with the top 12*b* being generally adapted for mechanical receipt of a cap 14 with, for example, a plurality of mechanical threads for receipt by an optionally threaded aperture or opening 12*c* generally located near the top 12*b*. The storage structure 40 generally located between the received inner and outer containers 20, 12, includes a top structure 40*a*, bottom structure 40*b* and inner sidewall structure 40*c* being generally adapted to store valuables 4.

FIG. 4 illustrates the device 10 in the closed position with the theft prevention mechanism 30 in the latched position, the elongated arm 32 being generally associated with the catch 18 of the outer container 12. The bias member 36 extends as the elongated arm 32 is pressed down, rotating the latch bar 34 from a selected position to a second selected position. The cap 14 being threadably received by the outer container 12 is also illustrated in FIG. 4 with the cap 14 associated with the threaded opening 12*c* and positioned adjacent to the elongated arm 32. Upon receipt of the cap 14 by the threaded opening 12*c*, the elongated arm 32 is pressed down, operably rotating the theft prevention mechanism 30 from the unlatched to the latched condition. FIG. 5 illustrates the device 10 in the open or unlatched condition, the inner container 20 being releasable from the outer container 12 and the elongated arm 32 being generally positioned away from the catch 18. The cap 14 is also illustrated in FIG. 5 spaced apart from the threaded opening 12*c* of the outer container 12.

In operation, as the cap 14 is removed from the threaded opening 12*c* the elongated arm 32 rotates from the latched to the unlatched condition, the depending lip 32*a* spaced a distance from the catch 18. As the cap 14 is received by the threaded opening 12*c*, the elongated arm 32 is pressed downward, rotating the arm 32 from the unlatched condition to the latched condition where the depending lip 32*a* is received by the catch 18. At this point, the device 10 is generally in the closed position with the inner container 20 being generally secured to the outer container 12. While the device 10 is in the open position, with the theft prevention mechanism 30 in the unlatched condition, valuables 4 may be placed within the inner container 20.

It will be appreciated that various other materials, configurations and embodiments may fall within the scope of the present invention. While certain forms of the present invention have been illustrated and described herein, it is not to be limited to the specific materials, forms or arrangement of parts described and shown.

Having thus described the invention, what is claimed as new and desired to be secured by Letters Patent is as follows:

1. A storage device for storing valuables comprising:

a cap, an outer container having an outer sidewall adjoining a top, said top receiving said cap, an inner container having an inner sidewall corresponding to said outer container sidewall and a bottom opposing said top, a storage structure between said inner container received by said outer container including an upper structure, lower structure and inner sidewall structure corresponding to said top, bottom and inner sidewall respectively wherein said structure is adapted to store valuables, a latch associated with said inner container and having an elongated arm, a latch bar rotating said elongated arm, and a bias member operably connected between said latch bar and said inner container, and a catch associated with said outer container adapted to securely receive said latch for operation between an unlatched position and a latched position for securing the valuables within the storage device; a threaded opening located near said top, and a plurality of threads on said cap for mechanically joining said cap with said threaded opening, wherein receipt of said cap drives the elongated arm towards said latched condition.

2. The storage device of claim 1 wherein. said elongated arm further comprises a depending lip adapted for receipt by said catch.

3. The storage device of claim 1 further comprising:

a first bias member receiver located on said latch bar, and a second bias member receiver located on said inner container wherein said bias member biases said latch towards said unlatched condition.

4. A storage device for storing valuables comprising:

a threaded cap, an outer container having an outer sidewall adjoining a top, said top receiving said threaded cap, an inner container having an inner sidewall and a bottom opposing said top, a storage structure positioned between said inner container and said outer container, said storage structure including an upper structure, lower structure and inner sidewall structure corresponding to said top, bottom and inner sidewall respectively, wherein said storage structure is adapted to receive stored valuables, a latch and catch assembly, said latch associated with said inner container, said latch comprising an elongated arm, said catch associated with said outer container, and said inner and outer containers adapted for slideable receipt between an unlatched position and a latched position wherein said latch and catch are secured at said latched position upon engagement of said elongated arm by said threaded cap wherein said inner container is telescopically received by said outer container.

5. The storage container of claim 4 wherein said latch further includes a bias member for biasing said latch in an unlatched position for slideable release of said inner container from said outer container.

6. The storage container of claim 4 wherein said latch includes a pair of bias members biasing the latch towards the unlatched position.

7. The storage container of claim 5 wherein said latch further includes a latch bar operably connected to said inner container by said bias member.

8. The storage container of claim. 4 further comprising organizing trays received within said storage structure for organizing the valuables.

9. The storage container of claim 4 further comprising a keylock for securing the inner and outer containers.

10. The storage container of claim 4 further comprising an interlocking fastener adapted for securing said inner and outer containers in the latched position.

11. A method for storing valuables, the method comprising:

providing an inner and an outer container configured to simulate a vehicle accessory said inner container including a catch and said outer container including a latch comprising an elongated arm, Biasing said catch and said latch in an unlatched position, opening said inner and outer container, storing valuables within. said inner container, telescopically receiving said inner container within said outer container, said inner and outer container moving from said unlatched position towards a latched position with said catch engaging said latch, and engaging said latch by a threaded cap to secure said inner and outer containers to a latched condition.

* * * * *